United States Patent [19]

Croce

[11] Patent Number: 4,672,817

[45] Date of Patent: Jun. 16, 1987

[54] AIR CONDITIONING COOLING DEVICE

[76] Inventor: Frank D. Croce, 2105 Sherwood Ave., Monroe, La. 71201

[21] Appl. No.: 698,838

[22] Filed: Feb. 6, 1985

[51] Int. Cl.[4] ..... F25B 39/04

[52] U.S. Cl. ..... 62/183; 62/181; 62/305; 62/506; 239/145; 239/590.3

[58] Field of Search ..... 239/145, 542, 590.3; 62/305, 506, 183, 181, 279

[56] References Cited

U.S. PATENT DOCUMENTS

| | | | |
|---|---|---|---|
| 3,946,762 | 3/1976 | Green | 239/145 |
| 3,984,995 | 10/1976 | Starr et al. | 62/305 |
| 4,193,269 | 3/1980 | Barry | 62/171 |
| 4,240,265 | 12/1980 | Faxon | 62/171 |
| 4,266,406 | 5/1981 | Ellis | 62/183 |
| 4,274,266 | 6/1981 | Shires | 62/171 |
| 4,353,219 | 10/1982 | Patrick, Jr. | 62/305 |
| 4,518,118 | 5/1985 | Takata | 239/172 |
| 4,559,789 | 12/1985 | Riek | 62/171 |

*Primary Examiner*—Larry I. Schwartz
*Attorney, Agent, or Firm*—Norvell E. Von Behren

[57] ABSTRACT

There is disclosed by the present invention a device for increasing the efficiency of the condenser unit of an air conditioner which consists of a predetermined length of copper tubing having perforations punched into it at regular intervals of approximately two inches, and which is covered by a sleeve made up of a woven textile material which is of the length equal to that length of tubing having perforations punched into it. The perforated length of tubing, ensheathed in the sleeve of woven textile material is laid atop the fins, of a condenser unit, which have been bent to accommodate this portion of the device resting on top of the condenser unit. When ambient atmospheric temperature rises above a certain temperature a thermostat causes a valve to allow water to flow into the device, when it flows out of the perforations in the copper tubing and is diffused by the wicking material along the length of the device until the wicking material is saturated. Upon saturation, water flows down the cooling fins and the cooling coils of the condenser increasing the efficiency of heat loss from the coolant in the condenser's coils both by evaporative and direct heat transfer processes.

5 Claims, 15 Drawing Figures

AIR CONDITIONING COOLING DEVICE

BACKGROUND OF THE INVENTION

1. Field of the Invention

Higher than average seasonal temperatures have a tendency to cause excessive wear and tear on air conditioning units. Therefore it is logical to try to find more efficient ways of operating an air conditioning unit in order to minimize the amount of time of operation of those portions of an air conditioner which are most prone to wearing out, such as pumps and compressors. One portion of the cycle of operation of an air conditioner causes vaporized coolant to become condensed. When it condenses, the coolant gives off the heat it is bearing which was removed from the air which the air conditioner was cooling. The process for increasing the amount of heat which can be removed from the condenser will result in more efficient operation from an air conditioning unit per given amount of time, and have a net result of decreasing the amount of time that an air conditioners pump or compressor needs to be turned on. This would give the two beneficial results of decreased energy consumption and decreased wear and tear on the air conditioning unit itself. The invention here provides a quicker and more efficient means for transferring heat from the condenser unit of an air conditioner.

2. Description of the Prior Art

The attempts which have been made to increase the efficiency with which a condenser dissipates its heat have largely centered on the approach of spraying water onto the cooling fins of the condenser. This had the effect of increasing the heat transfer of the condenser by causing air which passed over the wetted cooling fins to evaporate the water and therefore to draw more heat off the fins in this evaporative process than would ordinarily have been drawn off the cooling fins.

Illustrative of this idea is the patent of Faxon, U.S. Pat. No. 4,240,265, whose apparatus applied a spray or mist of water directly onto the coils and the fins of a condenser. Faxon made use of a spray nozzle to apply a mist, and included a control system so that whenever the temperature of the surroundings exceeded a predetermined point, a temperature sensor would open a valve thereby permitting water to be sprayed through the nozzle for a period of time, until the surrounding temperature dropped below a certain predetermined point.

The invention of Shires, U.S. Pat. No. 4,274,266, made use of a plurality of spray nozzles that would spray water over the coils of the cooling fins of the condenser. Once again, the stream of water was controlled by a valve which would be opened and closed in response to the temperature of the exhaust air stream which a motor driven fan would cause to flow over the condenser.

The invention of Ellis, U.S. Pat. No. 4,266,406, again made use of the idea of spraying water onto the condenser coils and fins. Ellis took this idea one step further however by using a mixture of tap water and of condenser water which was collected from the runoff from the evaporation coils, in the belief that using such a mixture would decrease the amount of mineral deposits which would form on the condenser coils and fins.

Starr, U.S. Pat. No. 3,984,995, did not use the principle of direct application of water to the condenser coils and cooling fins. Instead, Starr chose to cool and treat the air which cooled the condensing portion of the machinery rather than to cool the condenser itself. Starr positioned a water evaporator in front of the air flow which hit the condenser of the air conditioner. Air flowing through the evaporator would first be cooled prior to its hitting the condenser unit. In order to cool the evaporator itself, Starr used a canvas bag positioned on the upper surface of his evaporator; the bag acted as a soaker sack when filled with water. That is, when it was filled with water, it would slowly allow water to diffuse downwards over the channels of his upstream evaporator.

The patents of Ellis, Shires, and Faxon, while putting to good use the principle of directly applying an external coolant to the condenser coils and cooling fins, presented a problem in that the amount of water that they used over a given period of time was relatively little, meaning that water would for some extent remain idle along its line. The effect of this would be that the water in the line would become heated or warmed to some extent and it would then be this heated or warmed water which would be applied to the coils for some certain period of time. This would be inefficient, counter-productive and possibly harmful if the water in the line become warm enough to cause a drastic rise in head pressure of the air conditioning unit. The invention here overcomes this problem by using a much higher relative rate of flow and therefore flushing heated water out of the supply line much more quickly than with the other prior art.

A second inherent problem with the prior art is the exposure of apparatus to environmental dangers such as dust, debris, leaves, animals, and playful children. The invention here is well protected by the housing of the air conditioning unit itself.

Furthermore, the present invention is more efficient in its cooling capacity than the prior inventions because of its higher volume of water which is being applied to the condenser. This is so for two reasons. Firstly, cooling is accomplished through the evaporative principle of water which is directly evaporating off of the condenser coils and cooling fins. Secondly, cooling is accomplished through a direct transfer of heat from the coils and fins to the coolant water itself flowing down and through the assembly.

The clear difference between the invention of Starr and the present invention is that the present invention acts directly to cool the condenser whereas the invention of Starr acted to cool the air which in turn was made to cool the condenser. This entailed a great deal of unnecessary equipment installation and a degree of unnecessary equipment maintenance, neither of which is a feature of the present invention which is both simple to install and simple to maintain. The soaking sock in the Starr invention is also prone to premature wear and decomposition unlike the water diffusing means in the present invention.

The present invention overcomes the short comings of the prior inventions through its simplicity of installation and maintenance, as well as through its increased efficiency through the use of the scientific principles of evaporation and direct heat transfer, thereby resulting in a more efficiently operating air conditioning unit, meaning less equipment failure and lower energy consumption rates.

SUMMARY OF THE INVENTION

The present invention provides inventive subject matter which overcomes the problems and satisfies the needs previously considered.

The present invention, which is a device to increase heat transfer from the condenser of an air conditioner, essentially comprises a predetermined length of perforated coolant conduit and a sleeve of predetermined length of wicking material, and this sleeve surrounds the length of the perforated coolant conduit.

The wick, which surrounds the length of perforated coolant conduit, is affixed to an upper surface of the air conditioner condenser, commonly resting atop the cooling fins. From the simplicity of the invention it can readily be seen that it is easy and inexpensive to install it upon an existing air conditioning unit, and similarly, it is easy and inexpensive to maintain. Since the device rests on top of the cooling fins and therefore within the housing of the air conditioner, the device is therefore protected from the ravages of the elements, as well as from animals and from accidental contact with humans. With coolant flowing through the system, the device increases the efficiency with which an air conditioner's condenser transfers heat from the air conditioner's coolant. The device makes use of not one but rather two principles of physics. It makes first use of the principle of evaporation, and it makes second use of the principle of direct transfer of heat from the fins to the device's coolant. This increase in efficiency therefore will be reflected in both a decreased consumption of energy since the unit will not have to run as long as it would otherwise, and also in reduced wear and tear of the moving parts of an air conditioner such as the compressor and the fan motor. A decrease in current for the unit should also be observed using the applicants invention.

DESCRIPTION OF THE PREFERRED EMBODIMENT

In order to give proper perspective to the inventive difference which the present invention presents over the prior art, it is necessary to briefly discuss that prior art.

Figure 1:
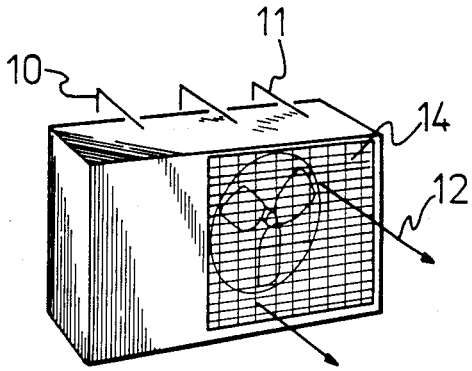
FIG-1 PRIOR ART
FIG. 1 is a depiction of the prior art as disclosed by the Shires patent, U.S. Pat. No. 4,274,266.
Figure 2:
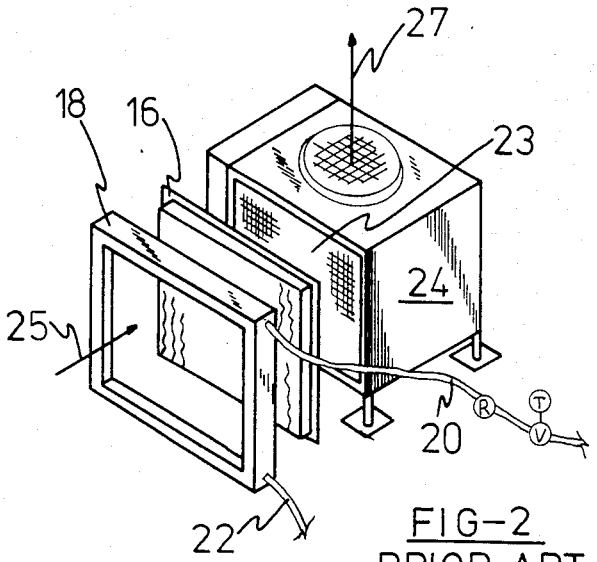
FIG-2 PRIOR ART
FIG. 2 is a depiction of the prior art disclosed by the Starr patent, U.S. Pat. No. 3,984,995.
Figure 2A:
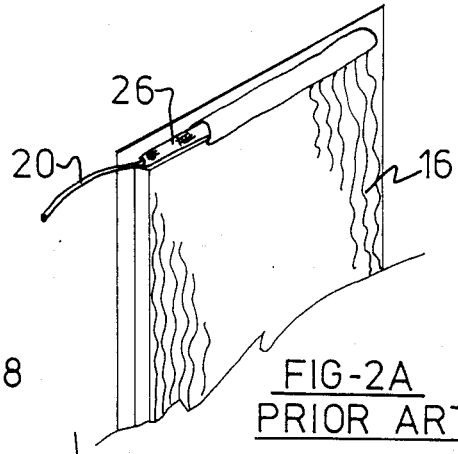
FIG-2A PRIOR ART
FIG. 2A is a second view of the prior art as disclosed by the Starr patent.

An approach representative of most of the prior art is that which is shown in FIG. 1. In FIG. 1, there is shown a typical air conditioner. The approach most often used in the prior art, as depicted in FIG. 1 was to use spray nozzles 10 mounted in some sort of a nozzle holding bracket 11 to spray water or another coolant directly onto the condenser cooling coils or fins 14 and make use of the evaporative effect which was created when the air conditioner's fan motor would cause a current of air in direction 12 to flow over the wetted condenser coils or fins. The second major direction which the prior art took was to apply an external coolant not to the condenser coolant coils and fins themselves but rather to the air which was made to flow over the condenser's cooling coils and fins. This is the approach which is depicted in FIG. 2. As shown there, an evaporative unit 16 housed within a frame 18, and composed essentially of a set of fins, was wetted by coolant from an external source. Air flowing in direction 25 then passed over this evaporative unit, causing the air to be cooled before the air came into contact with the condenser coils 23 of the condenser unit 24. Once having passed over the condenser unit's coils the airflow would then continue in direction 27. The coolant was made to pass through an inlet 20 and as it coursed down the evaporator 16, made its way through an outlet 22. At the top of the evaporative unit 16 there sat, as shown in FIG. 2A, a device known as a soaker sock 26. The sock 26 would fill with water or another coolant from the inlet 20 and slowly allow water to trickle down over the evaporative unit 16 which would cool the air which was meant in turn to cool the condenser coils and fins on the air conditioning unit 24.

Figure 3:
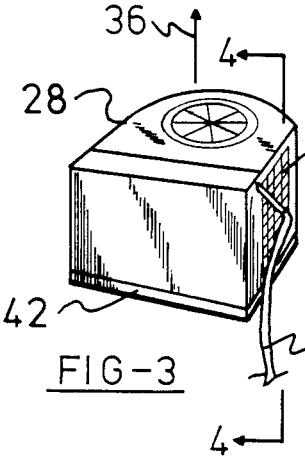
FIG. 3 is a general view of a typical air conditioning unit having the applicant's novel invention attached thereto.
Figure 4:
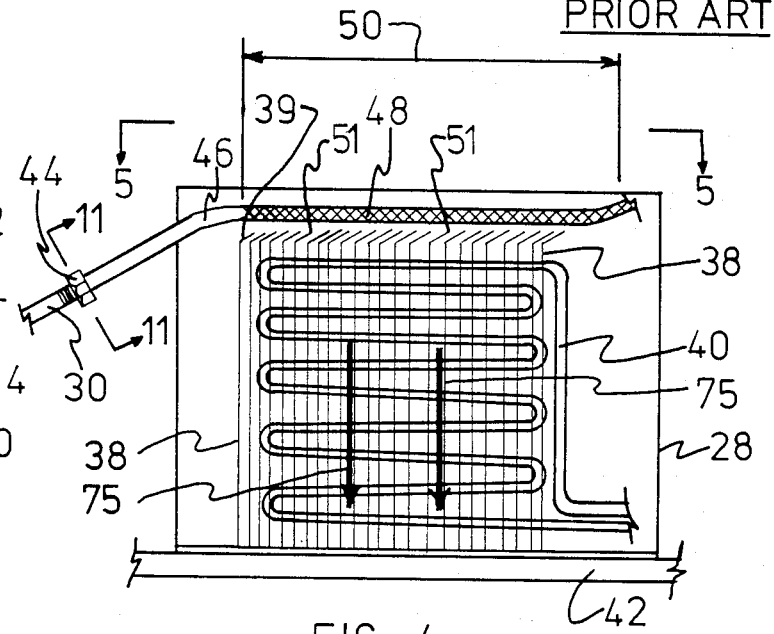
FIG. 4 taken along line 4—4 of FIG. 3, is a side view showing a portion of the typical air conditioner's condenser pipes, coolant fins, and the present invention affixed to the top of the coolant fins.
Figure 8:
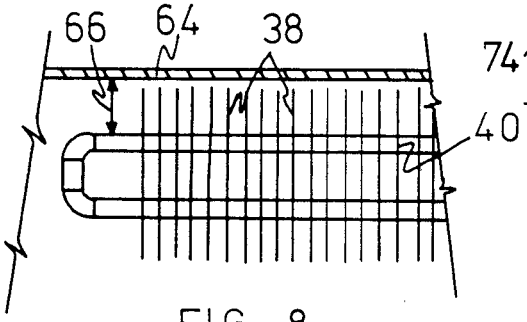
FIG. 8 is a detailed view of a portion of the condenser's cooling pipes, its cooling fins, and its upper housing, prior to installation of the present invention.

In a typical setup involving the present invention, as shown in FIGS. 3 and 4 of the drawing, a typical air conditioning unit 28 generally sitting on a concrete bed 42, draws in cooling air along line of flow 34 and then exhausts that air after the process has been completed along line of flow 36. An imaginary removing of the front grill 32 of the air conditioning unit 28 reveals the air conditioning unit's condenser coils and fins shown in detail in FIG. 8. In the typical air conditioning unit condenser, the refrigerant coils 40 course backwards and forwards, traversing through a very large number of cooling fins 38. A hood or a casing 64 is generally mounted on top of the fins creating a space 66 between the tips of the fins and the casing.

Figure 5:
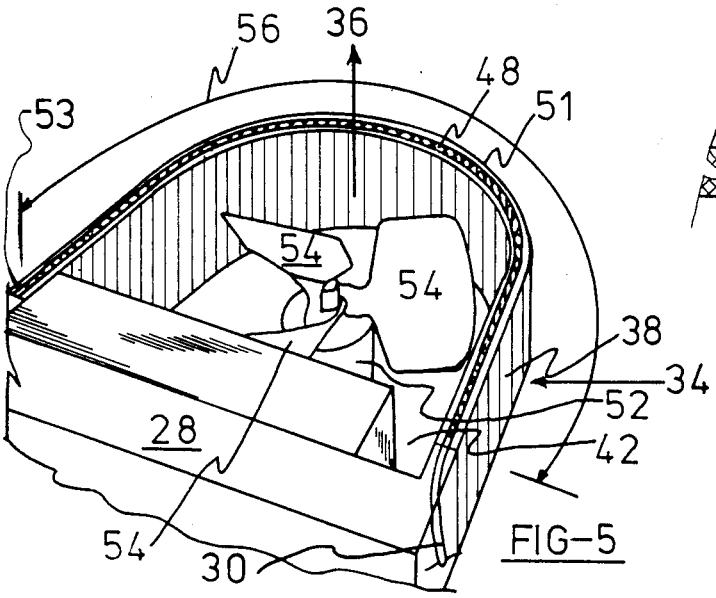
FIG. 5, taken along line 5—5 of FIG. 4, shows the typical air conditioner with its upper housing removed revealing the full array of the condenser's cooling fins with the present invention mounted on the uppermost surface of the array of the fins.

Turning now to FIG. 4 there is shown a somewhat broader view of the section of the condenser's refrigerant coils 40 coursing back and forth through a large number of cooling fins 38. In FIG. 4 however, the air conditioning cooling device has been installed. The tips of the coolant fins 38 have been bent in a uniform, oblique angle 39. Resting atop the bent fins 39, is the perforated cooling conduit 46, and sheathed in a length of the wicking material 48. The portion of the tubing sheathed in the wicking which is represented by the length delineated by numeral 50, is the portion of the coolant conduit which is actually perforated. It is important to understand that the length of the cooling conduit which is perforated varies according to the dimension of the condenser, as is made more clear in FIG. 5. In FIG. 5, there is shown with the external housing removed, an air conditioner's condenser, in this case taking on a horseshoe shape. In this instance, the length of coolant conduit which is perforated is represented by the arcing line 56 which follows a length of perforated copper conduit ensheathed in wicking, and which sits atop the tops 51 of the bent fins 39 of the entire periphery of the condenser's fins 38. Air is pulled along line of flow 34 by the action of the fan blades 54 driven by the motor 52 and then exhausted along direction 36. Returning now to FIG. 4, there is shown a coolant inlet 30 attached by the coupling 44 to the cooling conduit 46, which will generally be a length of copper tubing. The copper tubing is then perforated along a portion of its length, as previously mentioned along a general line of demarcation represented by numerals 50 and 51 and is then sealed off by a crimp or seal 53 having traversed the entire number of cooling fins 38. Again, it is that portion of the tubing which is perforated which is ensheathed by the wicking 48.

Figure 9:
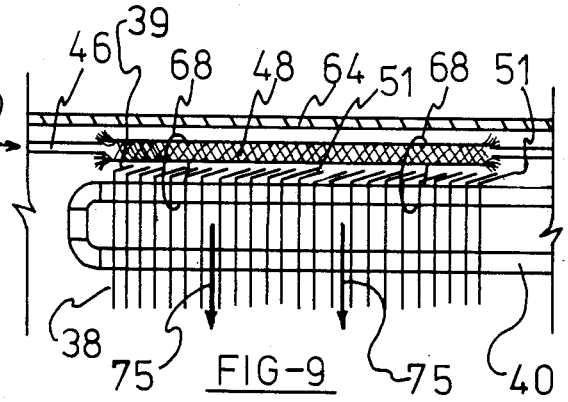
FIG. 9 shows the same view as FIG. 8, now with the present invention installed.

Turning now to FIG. 9 there is shown a portion of the invention in greater detail being mounted on a set of cooling fins of the condenser. The wicking ensheathed length of cooling conduit is affixed by means of several loops of mounting wires 68 which are made to loop around one of the condenser's refrigerant coils 40 up and over the wicking ensheathed portion of the perforated cooling conduit to hold it in place.

Figure 6:
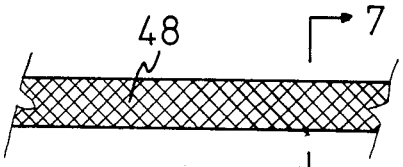
FIG. 6 is a detailed side view of a portion of the wicking used in the invention.
Figure 7:
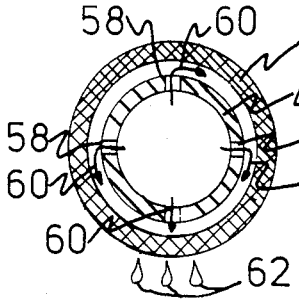
FIG. 7 is a cross-section taken along line 7—7 of FIG. 6 showing the wicking forming a sleeve around the perforated cooling conduit, and is not drawn to scale in order to show the diffusion pattern which water takes when escaping from the perforations in the coolant conduit as it diffuses throughout the wicking.
Figure 10:
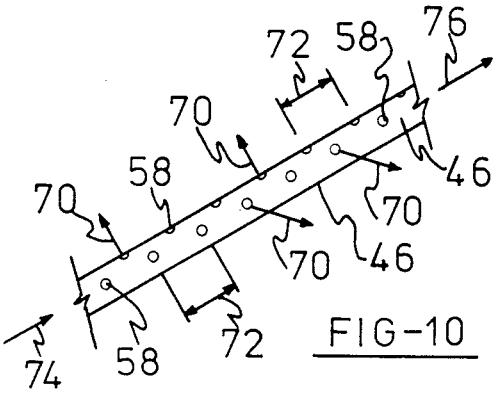
FIG. 10 is a perspective view of a portion of the perforated coolant conduit with the outer wicking removed showing the approximate spacing of the perforations in the conduit, and the direction in which water flows out of the perforations and diffuses along the length of the conduit.

FIG. 6 shows a portion of the wicking which is a woven textile preferably of rayon, nylon or cotton which has been woven to form a sleeve. Turning now to FIG. 7 it can be seen that the sleeve formed by the wicking 48 surrounds the perforated cooling conduit 46. Cooling conduit 46 will have a multiple of perforations 58. Water flowing through the conduit 46 will then seep out of the perforations 58 along the line of flow 60 into the interface between the conduit 46 and the wicking 48. (The space between the wicking 48 and the conduit 46 is not drawn to scale, it has been enlarged to show generally the direction of water flow 60.) After the wicking has been throughly profused by water seeping through the holes 58, water will then tend to flow downwards pulled by gravity to form downward falling droplets 62. Turning now to FIG. 10 there is shown roughly the spacial orientation of the holes 58 along a given length of the conduit 46. Water flows into the conduit along direction of flow 74 continuing generally along direction of flow 76 however, a certain faction of the water will flow outwards through the perforations 58 in direction 70 to be diffused along the length of the conduit 46. The perforations will have approximate spacing as represented by dimension 72 of approximately two inches and will be approximately 1/16 of an inch in diameter.

Returning now to FIG. 9, in actual operation, the coolant, preferably water, moves along direction of flow 74 through the perforated portion of the coolant conduit 50, escapes through the perforations, profuses the wicking 48, and then is pulled downward by the force of gravity into droplets which wet the surface areas of the cooling fins 38, and the refrigerant coil 40 in a generally downward direction 75. Returning briefly to FIG. 4, as that portion of the coolant which has not actually evaporated off of the surface of the fins or of the refrigerant coil, reaches the bottom of the condenser unit, it is drained away via the concrete base 42 according to drainage technology well known in that art.

Figure 11:
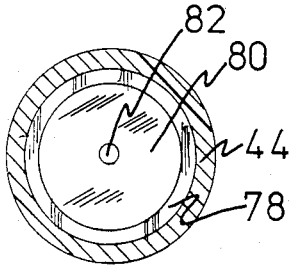
FIG. 11 is a front view of the orifice plate, not drawn to scale, showing the orifice plate in which the orifice is drilled and the hose or conduit coupling in which the orifice is seated.
Figure 12:
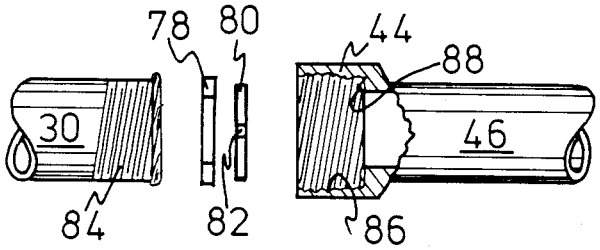
FIG. 12 is an exploded view showing the male threaded coupling of the external coolant source, the female threaded coupling leading to the perforated coolant conduit, the orifice plate and the washer which holds the orifice plate in place inside the coupling.

There is shown now in FIG. 11, which is taken along line 11—11 of FIG. 4, an orifice plate 80. The purpose of the orifice plate 80 is to control the volume of water entering into the perforated water or coolant conduit 46 and keep that volume constant despite varying coolant or water pressures being supplied to the system. The orifice plate 80 has an orifice 82 drilled or punched into its center, and the orifice may be of different diameters depending on whether or not an increased or decreased rate of flow is desired to meet the climate conditions of the local area. The installation kit for the air conditioning cooling device therefore comes with several orifice plates having a variety of different sizes of orifices drilled or punched into them. The orifice plate itself can be any material which is non-corrosive upon exposure to water. These can be metals such as tin or aluminum or non-porous materials such as rubber or resilient plastic. The washer 78 is seated against the orifice plate 80 as is shown more clearly in the exploded view of FIG. 12. The combination of the washer 78 and the orifice plate 80 is seated within a threaded female type coupling 44 against the internal coupling seat 88. When the male threads 84 of a water inlet, typically a garden hose, are inserted and tightened against the female threads 86 of the coupling 44 there is then formed a coolant watertight seal involving the coolant or water inlet 30, the washer 78, the orifice 80, the coupling seat 88 and the copper cooling conduit 46.

Figure 13:
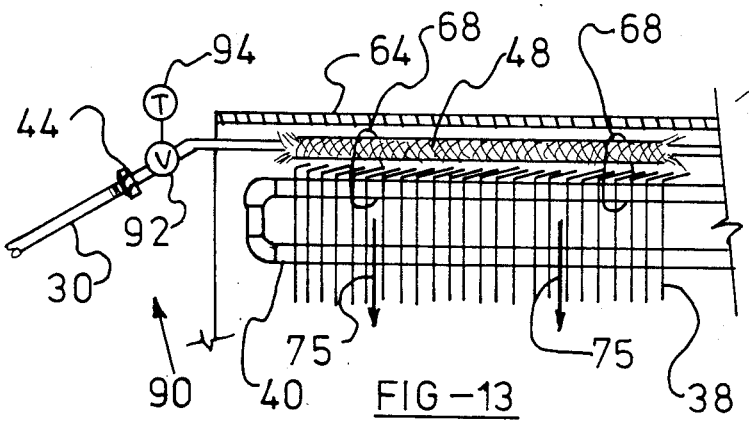
FIG. 13 is a schematic view of a modification of the preferred embodiment described herein.

Turning now to FIG. 10 it is contemplated that the average distance between the holes of the perforations in the copper tubing will be approximately two inches as shown by the dimensions 72. It is contemplated that the copper tubing will have an outside diameter of $\frac{1}{4}$ inch. It is further contemplated that the most typical size of orifice to be used in the orifice plate will have a diameter of 1/16 of an inch. Turning now to FIG. 13 there is shown schematically an arrangement whereby the flow of water through the air conditioning cooling device shown generally by the numeral 90, is controlled by some type of valve 92, perferably a solenoid type valve, which is directed to open and close by a thermostatic means 94 in response to changes in ambient atmospheric temperature. When ambient atmospheric temperature would drop below a predetermined level, the thermostat 94 would cause the valve 92 to close thereby conserving water flow through the air conditioning cooling device.

Figure 14:
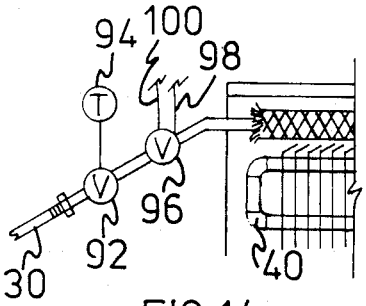
FIG. 14 is a schematic view of a further modification of the preferred embodiment described herein.

Turning now to FIG. 14 there is shown a further modification of the applicant's invention wherein there is installed in the coolant inlet 30 an electric solenoid operated valve 96 which would be connected in parallel with the fan motor 52 by means of the electric lines 98 and 100. The solenoid valve 96 would then operate to shut off coolant water flow through the coolant inlet 30 whenever the fan motor 52 turns off and would open to permit coolant flow when the fan motor 52 comes on. The use of the solenoid valve 96 would then minimize the amount of cooling water needed and prevent wasted water discharge when the fan motor 52 is not operating.

From the foregoing it can be seen that the applicant's novel cooling device has practical values, especially above 90° F. By using the device in extremely hot areas such as the southern part of the United States for instance, the hotter it gets above the 90° F. temperature, the greater the value of the device as a mechanism to assist the basic air conditioner. The applicant's device can be sized and shaped to adapt to the different types of air conditioning units and such a modification is within the spirit and scope of the invention. By the use of the orifice plate 80 having the orifice hole 82 contained in the center thereof, in experimentation it was found that a rate of approximately 48 gallons per hour on the coils on the condenser unit with a 1/16" diameter orifice was satisfactory to have a useful cooling effect on the condenser coil. In areas where the cooling water used is colder than in the test installation, less water may be required to cool the coils of an average air conditioner and smaller size orifice holes 82 may be also used. One indication of the effectiveness of the applicant's unit would be to measure the exhaust air coming out of the condenser unit in the direction shown by the arrow 36 in FIG. 3. When the air coming out of the condenser unit 28 in the direction shown by numeral 36 feels nearly the same as the surrounding outside air, this would be an indication of optimum performance and maximum heat transfer to the water coolant dripping on the air condenser fins through the perforated tubing and the outer wicking.

It is preferable that the volume of water be controlled coming into the perforated tubing so that a surplus of water does not hit the fan blades 54 thereby having a deteriorating effect on the fan 54 and the motor 52.

The amount of cooling water draining through the condenser unit onto the concrete base 42 of the condenser can be trapped and used for other purposes if desired by means known in the art. For example the hot water runoff can be collected and circulated by known means to a hot water tank or used to water a garden and for other purposes within the spirit and scope of the invention. By use of the modification shown in FIG. 13 with a thermostat set at 90° F., the actual water used in the applicant's device is decreased thereby saving water. For example if the temperature would drop below 90° F., the applicant's invention would be deactivated by the valve 92 until the temperature again rose above 90° F. By the use of tap water from an outside hose bibb it has been found that the tap water source is generally cooler since it is drawn from a well or river usually, and travels underground in a relatively cooler environment from the outside air. Accordingly by using tap water in the applicant's invention it has been found that the tap water absorbs a major portion of the heat when circulated through the perforated tubing and the wicking and dripped onto the fins of the condenser unit, thereby acting as a major assist to the condenser unit in extremely hot weather.

Accordingly with the applicant's novel invention, electrical current is reduced and the cooling capacity of an air conditioner may increase approximately one ton which is probably actually lost capacity in the air conditioning unit due to the extreme high temperatures encountered in many southern areas. The "on time" period of the air conditioner is also reduced due to the increase in capacity using the applicant's novel invention and all of these factors result in monitary savings to an individual on his electrical bill due to the efficient use of electricity by the compressor during high heat periods.

It is also believed that one of the major advantages in the applicant's invention is the reduction of head pressure in the air conditioning unit especially during high heat periods or where the unit is out in a high heat area such as roofs or set on concrete where solar radiation will have a deleterious effect. By the use of the applicant's invention, the probability of his air conditioner breaking down in 100° F. outside heat is minimized. Another important factor in using the applicant's invention would be the lessening of the strain on the air conditioner compressor resulting in a lesser probability of breakdown by extending the compressor life.

It is felt that prior art devices attempting to cool air conditioning condensers would tend to use less water but the lesser amounts of water used would also mean that the water would tend to stay in the supply line longer, presenting certain problems. For example when the supply water remains idle in the line it would be subject to heating effects from various sources such as sunlight, hot or warm areas or objects around the supply line and other sources resulting in a condition where the water actually supplied would be applied warm or even hot on the coils, as for example where they would be sprayed on as typified in prior art FIG. 1 versions. The use of fine mist nozzle arrangements in several of the prior art inventions would tend to indicate that a fairly low rate of flow of coolant water was being used which could result in the heating problem mentioned prior to application at the nozzles.

In distinction the applicant's new and novel invention uses a higher rate of flow which has a tendency to "flush" the supply line with cool water rather rapidly which would also result in greater heat transfer using the cold water as opposed to hotter water of the prior art devices. It is also felt that head pressure in the air conditioning unit could rise drastically if a hotter temperature water was to be sprayed on the coils for more than just an instant and the continued spraying of hot water on the coils could result in damage occurring which would be invisible and which would go undetected until the air conditiong unit actually broke down due to the extreme high head pressure caused by the hot water spray.

The applicant's basic invention is virtually maintenance-proof and the wicking 48 used around the perforated copper tube 46 can be replaced as needed which would be the only maintenance item required in the applicant's invention. By placing the wicking and perforated tube combination on top of the bent fins inside of the condenser unit, the applicant's invention is not subject to open exposure to the ravages of the weather such wind, flying debris, ice, snow, hail and other things which could hurt the invention. The prior art devices, when positioned outside of the condenser unit, are subject to all of the before-mentioned exposures which could result in damage to the spray nozzles to the evaporator causing further problems in their installation and use. The applicant's device requires only a disconnection from the water line in winter where freezing conditions occur in order to allow drainage and to prevent frost damage to the copper tubing 46.

From the foregoing it can be seen that there has been provided by the applicant's invention a new and novel cooling device for use on an air conditioning condenser and having other uses within the spirit and scope of the invention. It should also be apparent from a review of the drawings and from a study of the specification presented herein and the claims appended thereto that changes may be made in the applicant's device such as rearrangement of parts, changes in structure and other changes all of which would be considered to be within the spirit and scope of the invention. The applicant is not to be limited to the exact embodiment shown which has been given by way of illustration.

Having described my invention, I claim:

1. A method of cooling an air conditioner condenser having a coil, the condenser coil having an upper surface comprising the steps of:

(a) providing a predetermined length of tubing having an inner diameter, an external diameter, an upper surface and a lower surface, and a plurality of radially spaced apart holes positioned on the tubing;

(b) attaching the tubing to the upper surface of the condenser coil;

(c) providing a wick having an internal diameter;

(d) positioning the wick over the tubing such that each of the plurality of spaced apart holes is covered;

(e) providing a supply of water; and (f) flowing water through the inner diameter of the tubing such that the water flows out of the plurality of holes and is wicked along the length of the lower surface of the tubing until the wick is saturated and as the water flows out of the plurality of holes, the wick serves to divert the water from the upper surface of the tubing and the water moves by gravity to the lower surface of the tubing and downwardly over the condenser coil thereby preventing the water from moving upwardly or outwardly in an uncontrolled manner in parts of the air conditioner other than the condenser coil.

2. The method of cooling an air conditioner condenser as defined in claim 1 wherein the internal diameter of the wick is approximately equal to the external diameter of the tubing.

3. The method of cooling an air conditioner condenser as defined in claim 1 wherein the tubing is copper tubing.

4. The method of cooling an air conditioner condenser as defined in claim 1 wherein the wick is made of a woven fibrous material.

5. The method of cooling an air conditioner condenser as defined in claim 4 wherein the woven fibrous material is such that will uniformly wick water, flowing out of the plurality of holes in the tubing uniformly along the entire length of the lower surface of the tubing.

* * * * *